United States Patent [19]

Barrett

[11] Patent Number: 4,916,756

[45] Date of Patent: Apr. 17, 1990

[54] BLANKET CONSTRUCTION

[76] Inventor: Nancy D. Barrett, 306 Sunrise Ct., Benicia, Calif. 94510

[21] Appl. No.: 367,793

[22] Filed: Jun. 19, 1989

[51] Int. Cl.[4] ..... A47G 9/02

[52] U.S. Cl. ..... 2/69.5; 2/243 B; 5/485

[58] Field of Search ..... 2/69, 69.5, 243 B, 243 R; 5/462, 482, 485

[56] References Cited

U.S. PATENT DOCUMENTS

| | | | |
|---|---|---|---|
| 633,134 | 9/1899 | Hansen | 2/69 X |
| 704,276 | 7/1902 | Sorensen | 2/69 |
| 1,263,825 | 4/1918 | Waugh | 2/69.5 X |
| 1,423,908 | 7/1922 | Burchard | 2/69 X |
| 1,584,853 | 5/1926 | Dern | 2/69 |
| 2,358,410 | 9/1944 | Matthesius | 2/69.5 |
| 2,442,105 | 5/1948 | Vacheron | 2/69.5 |
| 2,675,552 | 4/1954 | Jackson | 2/69.5 |
| 2,716,239 | 8/1955 | Barndollar | 2/69.5 |
| 2,989,753 | 6/1961 | Burner | 2/69.5 |
| 3,412,407 | 11/1968 | Key | 2/69.5 |
| 4,125,903 | 11/1978 | Farrell | 2/69.5 |
| 4,142,264 | 3/1979 | Whiting | 5/334 |
| 4,178,637 | 12/1979 | Wrightson | 2/69.5 |
| 4,363,141 | 12/1982 | Doster | 2/69.5 |
| 4,534,065 | 8/1985 | Comfort | 2/69.5 |
| 4,611,353 | 9/1986 | Als et al. | 2/69 |
| 4,616,365 | 10/1986 | Lyons | 2/69.5 X |
| 4,656,670 | 4/1987 | Schluter | 2/69 X |
| 4,656,682 | 4/1987 | DeFelice et al. | 5/485 X |

FOREIGN PATENT DOCUMENTS

| | | | |
|---|---|---|---|
| 176816 | 5/1953 | Austria | 2/69.5 |
| 484456 | 5/1938 | United Kingdom | 2/69 |

*Primary Examiner*—Werner H. Schroeder
*Assistant Examiner*—Jeanette E. Chapman
*Attorney, Agent, or Firm*—Schapp and Hatch

[57] ABSTRACT

A blanket construction adapted for use in covering an individual reclining on surfaces such as couches or reclining chairs formed with a square body of blanket material having one corner cut off at approximately 45° angle and having a separate piece of blanket material secured to the body at such corner to provide a foot receiving pocket, the edge of such piece at the opening being hemmed and provided with an elastic member for converting the pocket to a pouch deep and wide enough to accomodate the feet of the user without requiring bending of or pressure on the feet.

6 Claims, 1 Drawing Sheet

BLANKET CONSTRUCTION

BACKGROUND OF THE INVENTION

1. Field of the Invention

This invention relates to blankets, and more particularly to the construction of blankets adapted for use while reclining on surfaces such as couches.

2. Description of the Prior Art

Persons often lie down on couches or recline on recliner chairs while reading, watching television, napping, etc. Ordinarily, such persons use a blanket or comforter to cover themselves and keep warm. Unfortunately, the comfort provided is minimal because the covering blanket is hard to arrange and keep in place during minor movements of the body of the user. This problem is particularly acute with regard to keeping the feet warm.

Various body garments have been proposed, such as those found in U.S. Pat. Nos. 2,716,239 to Cora M. Barndollar, 4,142,264 to Richard T. Whiting, 4,178,637 to John C. Wrightson, and 4,534,065 to Gloria N. Comfort. Each of these body garments requires that the user sit upon it and pull the edges together in the front, where they are held by zippers or buttons.

It is difficult for the user to arise quickly, because he or she must first undo the fastenings, must throw off the front portions of the body garment, and then arise from the body garment.

U.S Pat. No. 4,363,141 to Elizabeth Doster shows a quilt for use as a lap cover for persons occupying wheelchairs. This quilt does not cover the upper portion of the body of the user, and the foot receiving pocket comes up to the back of the knee area.

U.S. Pat. No. 2,442,105 to Lucy Vacheron shows a multipurpose blanket which can either be sat upon, leaving the front of the user exposed, or can be pulled up over the front of the user to the chest area, leaving the user's arms exposed.

Other patents showing baby receiving blankets upon which the infant lies and having foot receiving pockets are listed as follows:

| U.S. Pat. No. | Inventor | Issue Date |
|---|---|---|
| 2,989,753 | L. Burner | 06/27/61 |
| 3,412,407 | V. Key | 11/26/68 |
| 4,125,903 | W. Farrell | 11/21/78 |

The above-listed patents are believed to be relevant to the present invention because they were adduced by a prior art search made by an independent searcher, and a copy of each of the above-listed patents is supplied to the Patent and Trademark Office herewith.

The term "prior art" as used herein or in any statement made by or on behalf of the applicant means only that any document or thing referred to as prior art bears, directly or inferentially, a date which is earlier than the effective date of this application.

No representation nor admission is made that any of the above-listed documents is part of the prior art in any acceptation of that term, or that no more pertinent information exists.

SUMMARY OF THE INVENTION

The blanket of the present invention is intended for use to cover the body of a person lying down on a couch or lying back on a reclining chair. The blanket is formed to cover the body of the user in the normal manner of a blanket, but in such a way that the blanket is held in place and the feet are protected.

The blanket of the present invention is provided by a substantially square body of blanket material having one corner removed at substantially a 45° angle. A piece of blanket material is sewn onto the underside of the body at the removed corner and is cooperative with the body to provide a pocket adapted for accomodating the feet of a person reclining under the substantially square body of blanket material. The corner of the square body of blanket material opposite to the pocket covers the chest of the user and is folded back as desired to adjust the distance the blanket comes up toward the user's chin.

Preferably the blanket material of the piece sewn onto the body to form the pocket is similar to the blanket material of the body itself, and cooperates with the body to form a warm and soft foot receiving pocket into which the user's feet are thrust when the user is under the body of the blanket.

The foot receiving pocket is substantially broader at its bottom so as to accomodate the feet of the user without requiring bending of the feet or of the toes. For this purpose, the piece sewn onto the body is provided with cut out gores having edges sewn together for forming the pocket substantially broader at its bottom.

In accordance with the invention, the piece sewn onto the body is formed with a hem along the open edge of the pocket and an elongated elastic member is contained within such hem and is attached at its opposite ends to the body of blanket material so as to convert the pocket into a foot receiving pouch. The tension of the elastic member puckers the hem along the open edge of the pocket, drawing the sides of the body closer together and providing increased warmth and protection for the feet of the user. At the same time, the pouch is wide enough and deep enough to accomodate the feet of the user even with the user's legs partially spread.

It is therefore a principal object of the present invention to provide a couch blanket to be worn in overlying relation to the reclining body of the user and with the feet of the user securely protected against the cold.

another object of the present invention is to provide a blanket construction of the character described in which the body portion is substantially square, with one corner removed, and a separate piece of blanket material sewn to the removed corner of the body cooperates with the body to accommodate the feet of the user without requiring bending of the feet or pressure upon them.

Another object of the present invention is to provide a blanket construction of the character described which is simple in form and design and is economical of material.

Other objects and features of advantage will become apparent as the specification progresses and from the claims.

Figure 1:
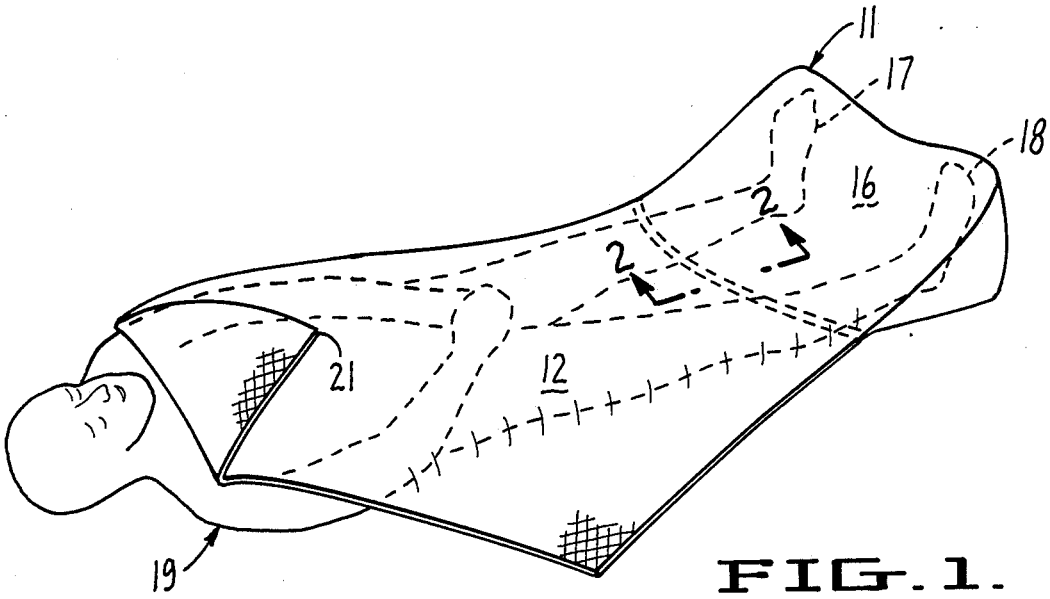
FIG. 1 is a perspective view of a blanket constructed in accordance with the present invention and shown in operative position upon the reclining form of a user.
Figure 2:
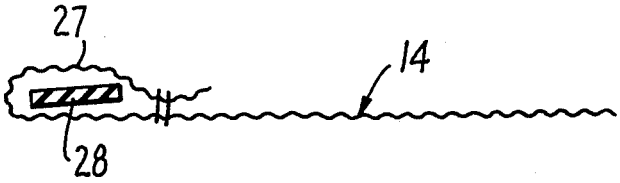
FIG. 2 is a vertical cross-sectional view on an enlarged scale of a hem portion of the blanket construction of FIG. 1.

While only the preferred form of the invention is illustrated in the drawings, it will be apparent that various modifications could be made without departing from the ambit of the claims.

DESCRIPTION OF THE PREFERRED EMBODIMENT

As may be seen in the accompanying drawings, the blanket construction 11 of the present invention utilizes a square body portion 12 of blanket material having one corner removed at 13 at substantially a 45° angle measured between an extension of the cut line or edge C2, and the adjacent sides of the body 12. A piece 14 of blanket material is sewn onto the underside of the body 12 at the removed corner 13 and is cooperative with the body portion 12 to provide a pocket 16 formed for accommodating the feet 17 and 18 of the user 19, when such user is reclining underneath the body 12.

As shown in FIG. 1 of the drawings, user 19 lies down or reclines upon a suitable surface, such as that provided by a couch or recliner chair, and spreads the blanket 11 over the body of the user 19. Because of the square shape of the body 12 of the blanket, corner 21 (opposite to removed corner 13) extends over the face of the user in such a manner that it can be folded back in the manner illustrated in FIG. 1 of the drawings to thus make the length of the blanket adjustable.

The blanket material of the piece 14 sewn onto body 12 is preferably of blanket material similar to the blanket material of body 12 for softness and warmth. The feet 17 and 18 of the user are thrust into the pocket 16 in the manner shown in FIG. 1 of the drawings, it being noted that the pocket 16 is sufficiently wide to permit some spreading of the legs of the user.

In accordance with the invention, the foot receiving pocket 16 is substantially broader at its bottom than at its opening so as to accomodate the feet 17 and 18 of the user 19 without requiring bending of the feet or toes, and without exerting undue pressure on the feet.

To accomplish this proportioning of the pocket 16, the piece 14 is provided with cut out gores 22 and 23 having edges B1 and B2 sewn together at 24 and 26.

Figure 3:
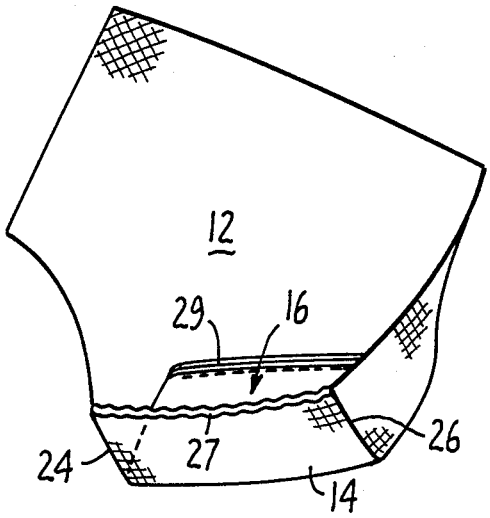
FIG. 3 is a perspective view of the blanket of FIG. 1 with the foot receiving pocket pulled open to reveal details of construction.

As may best be seen in FIG. 3 of the drawings, the piece 14 is formed with a hem 27 along the open edge of the pocket, and an elongated elastic member 28 is contained within the hem 27 and is attached at its opposite ends to the body of blanket material so as to convert the pocket into a foot receiving pouch. Because of the elastic member, the size of the opening of the pouch is variable so the feet of the user 19 can be spread apart as illustrated in FIG. 1 of the drawings, or moved together, in which case the elastic member draws the pouch closer around the legs of the user above the feet.

Figure 4:
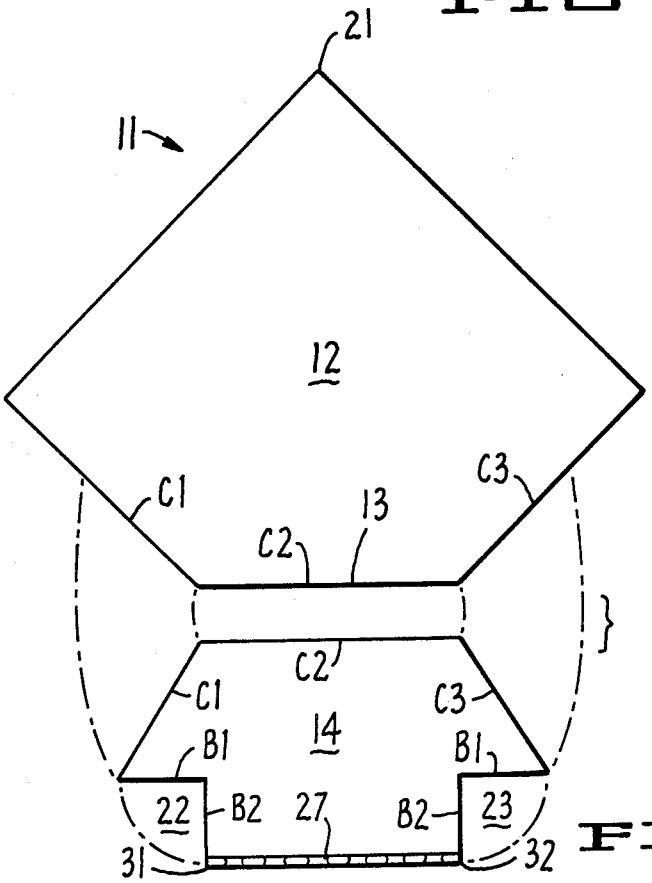
FIG. 4 is a plan view of a pattern layout for constructing the blanket of FIG. 1.

As illustrated in FIG. 4 of the drawings, edges C2 of the body 12 and piece 14 are sewn together at 29. Sides C1 on body 12 and piece 14 are sewn together as are sides C3. End 31 of hem 27 is attached to side C1 of body 12 and end 32 is attached to side C3 of body 12.

From the foregoing, it will be seen that the blanket construction of the present invention provides a novel and useful blanket construction well adapted for use by people reclining on couches or in recliner chair.

What is claimed is:

1. A blanket to be worn in covering relation to the front of the user's body, comprising a substantially square body of blanket material having one corner removed at substantially a 45° angle when measured between an extension of the cut line and one side of said square, a piece of blanket material sewn onto the underside of said body at said removed corner and cooperative with said body to provide a pocket formed for accommodating the feet of a person reclining under said substantially square body of blanket material.

2. A blanket construction as described in claim 1, and wherein said blanket material of said piece sewn onto said body is similar to said blanket material of said substantially square body.

3. A blanket construction as described in claim 1, and wherein said piece sewn onto said body cooperates with said body to form a foot receiving pocket into which the user's feet are thrust when the user is under said body of said blanket.

4. A blanket construction as described in claim 1, and wherein said foot receiving pocket is substantially broader at its bottom so as to accommodate the feet of the user without requiring bending of the feet or toes.

5. A blanket construction as described in claim 4, and wherein said piece sewn onto said body is provided with cut out gores having edges sewn together for forming said pocket substantially broader at its bottom.

6. A blanket construction as described in claim 1, and wherein said piece sewn onto said body is formed with a hem along the open edge of said pocket, and an elongated elastic member is contained with said hem and is attached at its opposite ends to said body of blanket material so as to convert said pocket into a foot receiving pouch.

* * * * *